United States Patent [19]

Gadberry

[11] 4,402,316

[45] Sep. 6, 1983

[54] BREATHING GAS MASK

[75] Inventor: Donald L. Gadberry, Huntington Beach, Calif.

[73] Assignee: U.S.D. Corp., Santa Ana, Calif.

[21] Appl. No.: 257,537

[22] Filed: Apr. 27, 1981

[51] Int. Cl.[3] ..... A62B 7/00

[52] U.S. Cl. ..... 128/201.15; 128/201.19; 128/206.21; 128/206.24

[58] Field of Search ..... 128/201.15, 201.19, 128/201.23, 201.24, 201.28, 206.15, 206.17, 206.23, 206.24, 207.11, 207.12, 206.12; 2/426, 427, 428, 430, 431, 447; 351/154, 166

[56] References Cited

U.S. PATENT DOCUMENTS

| | | | |
|---|---|---|---|
| 645,408 | 3/1900 | Vajen | 128/201.23 |
| 2,792,000 | 5/1957 | Richardson | 128/201.15 |
| 2,898,908 | 8/1959 | Sovinsky | 128/206.15 |
| 3,348,537 | 10/1967 | Miller et al. | 128/201.19 |
| 3,353,534 | 11/1967 | Savoie, Jr. | 128/201.24 |
| 3,602,219 | 8/1971 | Warncke | 128/201.15 |
| 4,276,877 | 7/1981 | Gdulla | 128/201.28 |

FOREIGN PATENT DOCUMENTS

| | | | |
|---|---|---|---|
| 1234531 | 2/1967 | Fed. Rep. of Germany | 128/201.13 |
| 2042346 | 9/1980 | United Kingdom | 128/206.15 |

*Primary Examiner*—Henry J. Recla

*Attorney, Agent, or Firm*—George F. Bethel; Patience K. Bethel

[57] ABSTRACT

The following specification discloses a breathing gas mask having an elastomeric or plastic main body portion supported by a head band formed with a number of supporting straps for holding the mask to a user's face. The mask has a large viewing lens with an elongated protuberance in the form of a bead extending around the periphery of the viewing lens for purposes of protecting the major lens surface from exposure to impacts and scratching when it is laid on its face. The mask incorporates an oral nasal interior breathing cover with a speaking diaphragm in adjacent relationship thereto to allow for the intake of breathing gas into the oral nasal mask area while allowing for exhalation through a poppet valve in connected relationship to the oral nasal mask. The outer mask seal incorporates a flared interior seal member around the inner periphery thereof which incorporates a compound curve having variable cross sectional shapes around the periphery thereof to allow for a tightened seal to a user's face.

15 Claims, 16 Drawing Figures

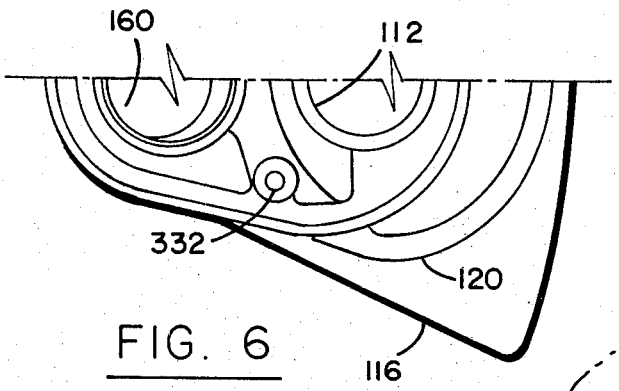
FIG. 6
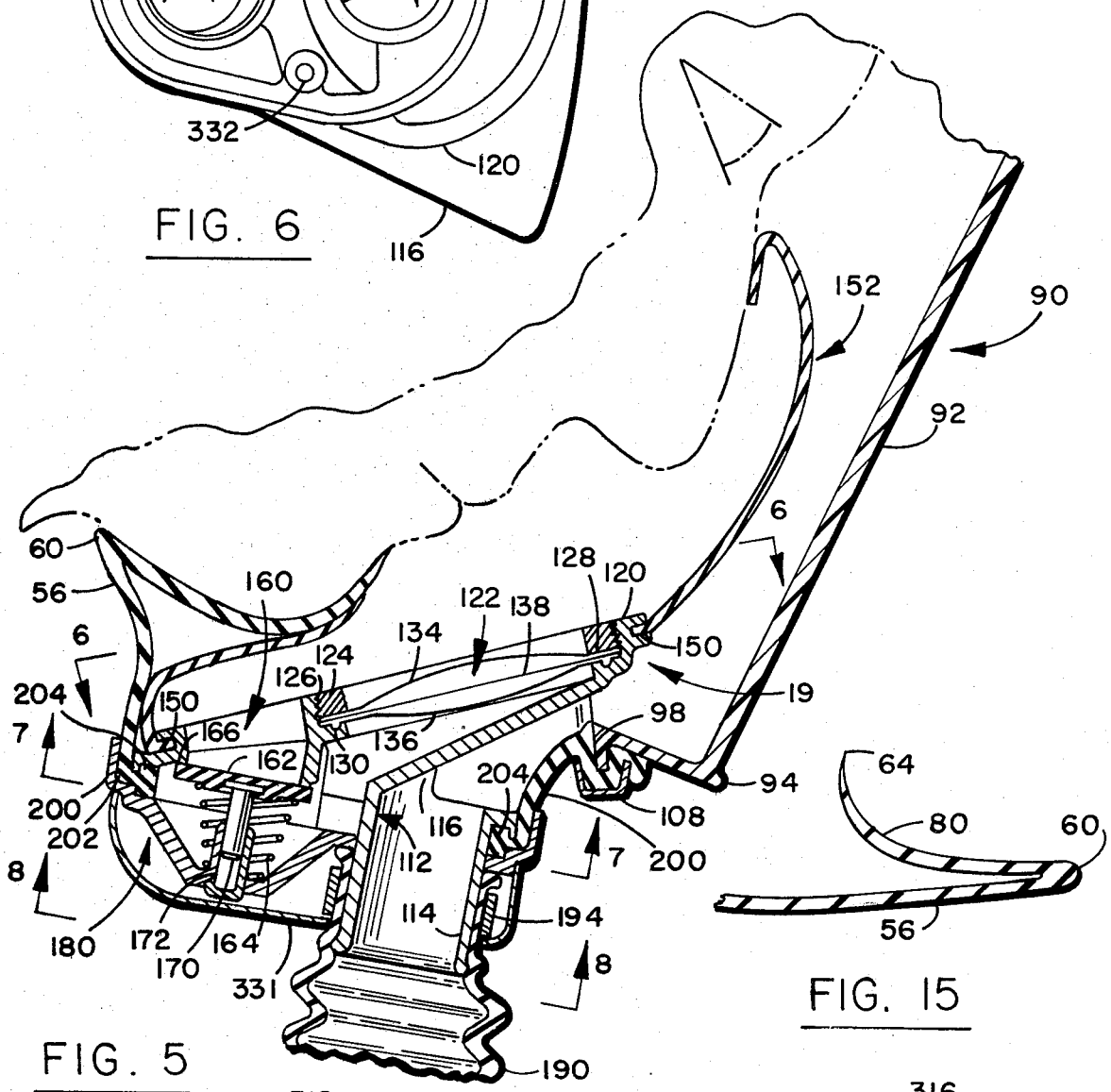
FIG. 5
FIG. 15
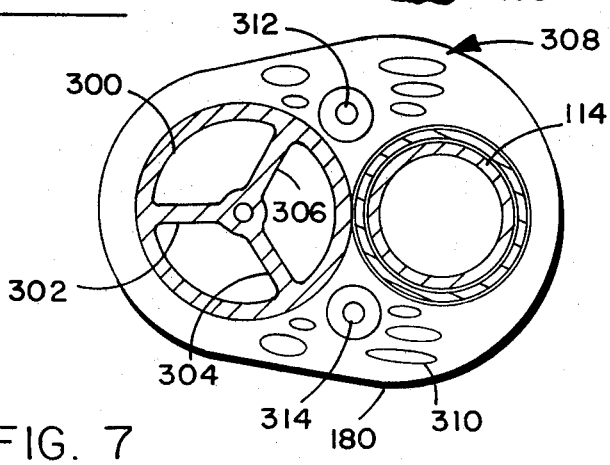
FIG. 7
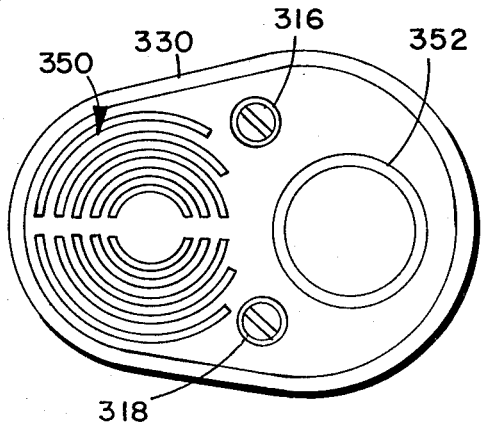
FIG. 8

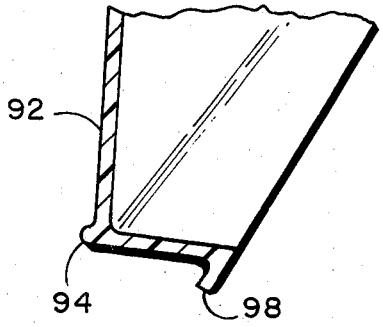
FIG. 11
FIG. 9
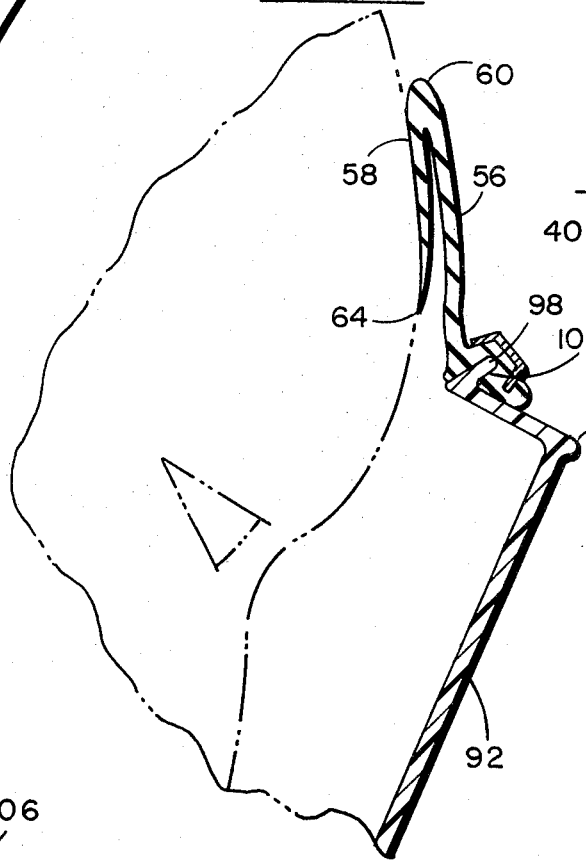
FIG. 16
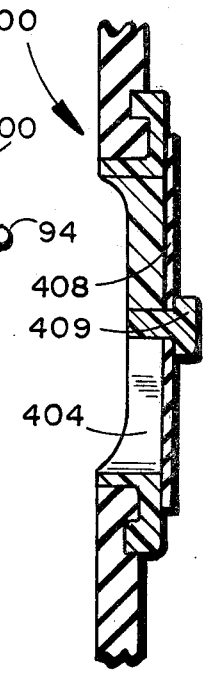
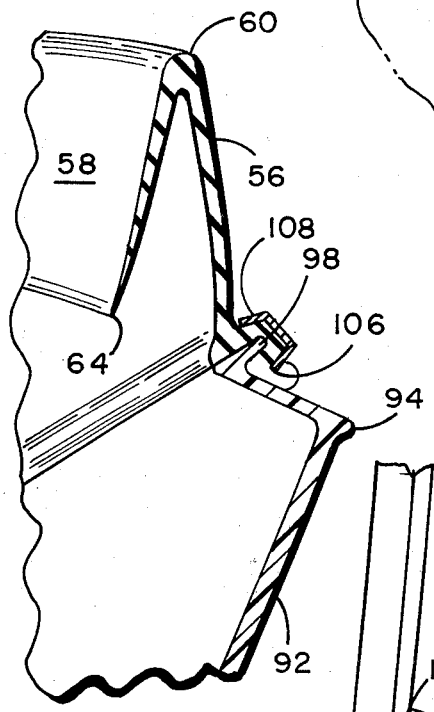
FIG. 10
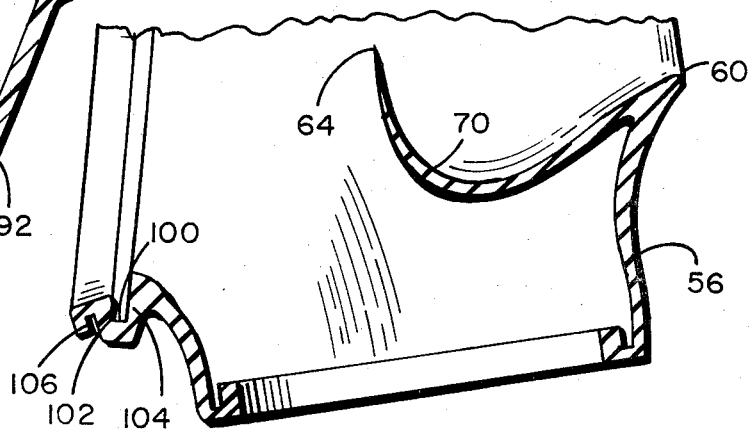
FIG. 12
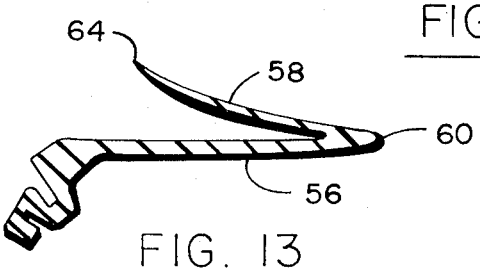
FIG. 13
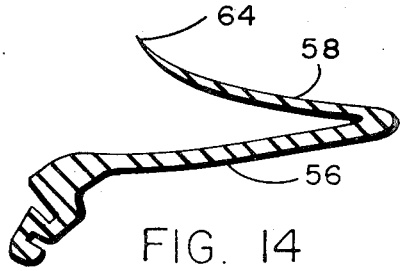
FIG. 14

BREATHING GAS MASK

BACKGROUND OF THE INVENTION

1. Field of the Invention

The field of this invention lies within the provision of breathing gas to a user. More particularly, it lies within the breathing gas mask art as it relates to self contained breathing apparatus for users such as firemen, industrial workers, and other users that require a life support system, as well as respirators.

2. The Prior Art

The prior art with regard to breathing gas masks has incorporated various configurations which have not fitted a user's face. Furthermore, the configurations oftentimes had lenses which were scratched after very short usage.

The scratched lenses created a situation wherein the vision from the mask became so blurred as to obliterate the view of a user. As can be appreciated, when the plastic viewing lens was particularly scratched and caused the view to be obliterated in part, the mask either had to be disposed of, or a new lens provided. This invention specifically seeks to overcome the deficiencies of the prior art by providing for a lens protection means. The lens protection means is formed as a flange circumscribing the lens at the outer edge thereof. The flange is raised from the surface of the lens sufficiently so that when it is rested on the lens, it supports the major lens surface away from the object or surface on which it is rested.

This serves to avoid scratching by the surface on which it is rested. Furthermore, as can be appreciated, such a flange provides certain impact resistance and reinforcement to help eliminate problems with regard to sharp impacts which would normally crack the lens.

The prior art breathing gas masks also did not have a sufficiently appropriate diaphragm through which one could speak. The diaphragms were of such a nature as to be either improperly disposed to convey a message, or not placed in a practical position for usage with respect to the other components of the mask. This invention provides a diaphragm through which one can speak effectively to a person nearby without having to take off the mask.

The prior art breathing masks did not have a conformation which was generally acceptable from the standpoint of comfort, seal, and fit. This mask is particularly designed so that it is supported effectively by the strap and head band. The placement of the mask is such that it is implaced in such a manner as to be comfortable and at the same time easily used without any appurtenant portions thereof.

One of the most important features of this mask over the prior art is the seal and its fit. In particular, prior art masks did not incorporate a seal and a fit which could accommodate a myriad of facial configurations.

As can be appreciated, masks have to accommodate a myriad of different facial configurations. Such facial configurations can include narrow, elongated, plump, high cheekboned, withdrawn cheeks, a well as other facial configurations, which all have to be met by the seal of such masks. This is not easily accomplished by the prior art and until this mask, it is not believed any such masks were effective in providing a seal to a broad range of facial features.

This mask also provides a deep seal portion which can be in the neighborhood of one and a half inches wide or greater around the entire interior periphery thereof. The seal incorporates an upward extending chin cup which causes one's chin to seat therein. In addition thereto, the entire seal around the periphery has a compound curved configuration that varies around the periphery thereof. This compound curved configuration curves inwardly so as to accommodate a user's face in closely sealed juxtaposition. Thus, the seal of the gas mask of this invention is a substantial step over the prior art. It fundamentally accommodates a multitude of facial configurations which are not capable of being accommodated by the prior art. Furthermore, it provides a tight and comfortable seal which was not available in the prior art.

As a consequence of the foregoing, this mask is a substantial step over the prior art and should be read broadly in light of its lens configuration and sealing configuration, as well as the entire combination thereof.

SUMMARY OF THE INVENTION

In summation, this invention provides a new breathing gas mask having an improved lens to prevent scratches and an improved seal which incorporates a compound curved cross sectioned configuration and a chin cup, as well as an improved combination of elements for a breathing gas mask.

More particularly, the invention incorporates a breathing gas mask having an elastomeric facial main body portion. The main body portion has a lens attached thereto which is sealed by a metal band circumscribing the lens and holding the elastomeric mask portion thereto. The lens has a raised flange or protuberances around the periphery thereof which prevents scratching of the major lens surface when it is placed on a surface and rested thereon.

The mask portion is supported by means of straps which are attached to a head band. The support is at various support portions to allow for adjustable movement and seating of the mask.

The mask has a diaphragm and poppet valve configuration for speaking and exhaling from an internal oral nasal cover. The oral nasal cover isolates the interior of the mask from the oral nasal areas to prevent fogging and reentrainment of air into the major cavity of the mask.

The seal for the mask is provided in a manner whereby it can comfortably accommodate a multitude of facial configurations. The seal can accommodate various facial configurations by virtue of its chin cup configuration and its compound curved portions which is in the form of a wide interiorly extending seal around the interior thereof. The seal thereby provides for an improved sealing of gas, while at the same time accommodating itself to various facial configurations.

The foregoing features will be more clearly understood in reference to the specification hereinafter and the claims directed thereto.

DESCRIPTION OF THE DRAWINGS

The invention will be more clearly understood by reference to the description below taken in conjunction with the accompanying drawings wherein:

FIG. 5 shows a detailed sectional view with a user's face within the mask as taken in the direction of lines 5—5 of FIG. 2;

FIG. 6 shows a plan view looking down at a divided midline portion as seen within the direction of lines 6—6 of FIG. 5;

FIG. 7 shows a view of the mask looking upwardly in the direction of lines 7—7 of FIG. 5;

FIG. 8 shows a view of the lower mask portion in the direction of lines 8—8 of FIG. 5;

FIG. 9 shows a detailed sectional view of the mask seating against a user's forehead as would be seen in the direction of lines 9—9 of FIG. 5;

FIG. 10 shows a detailed view of the lens and mask seal as generally seen in the same area of FIG. 9 without the mask being impressed against one's forehead;

FIG. 11 shows a detailed sectional view of the supporting flange as seen through circle 11 of FIG. 1;

FIG. 12 shows a sectional view of the chin cup and lower portion of the mask as seen in the direction of lines 12—12 of FIG. 3;

FIG. 13 is a sectional view of the seal of the mask as sectioned through lines 13—13 of FIG. 1;

FIG. 14 is a second sectional view showing the seal as sectioned through lines 14—14 of FIG. 1;

FIG. 15 is a detailed sectional view as sectioned through lines 15—15 of FIG. 1 to show the seal thereof; and, FIG. 16 shows a side view of the inhalation valve of the oral nasal mask in the direction of lines 16—16 of FIG. 4.

DESCRIPTION OF THE PREFERRED EMBODIMENTS

Figure 2:
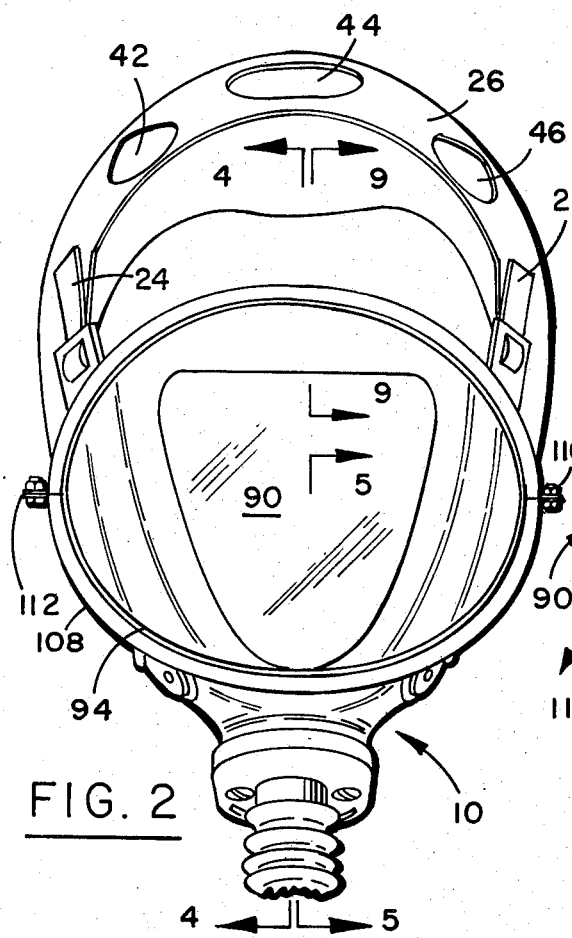
FIG. 2 shows a front elevation view of the gas mask as seen from the left of the showing of FIG. 1.
Figure 1:
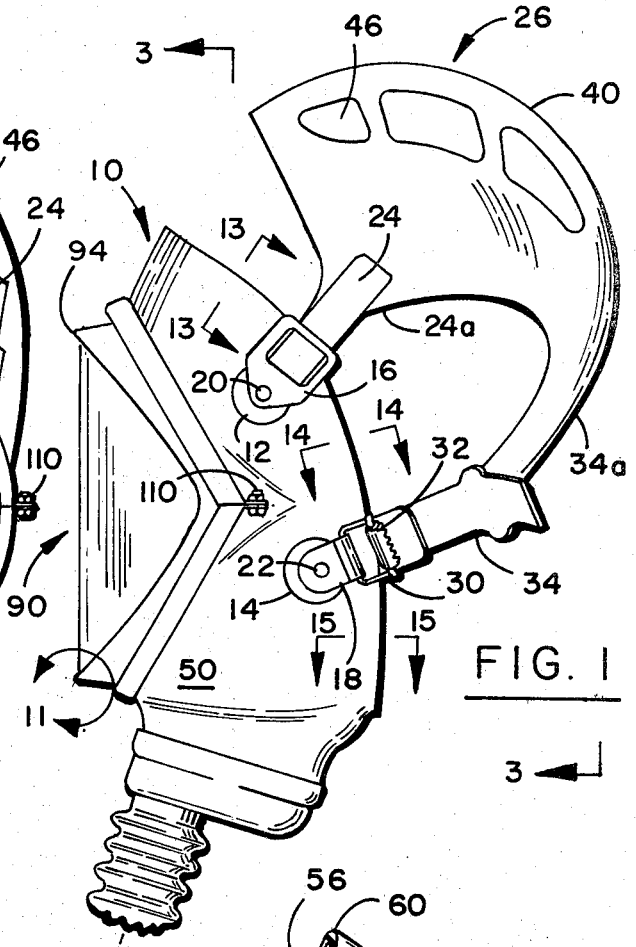
FIG. 1 shows a side elevation view of the breathing gas mask of this invention with the gas supply hose in a split fragmented configuration with respect thereto.
Figure 3:
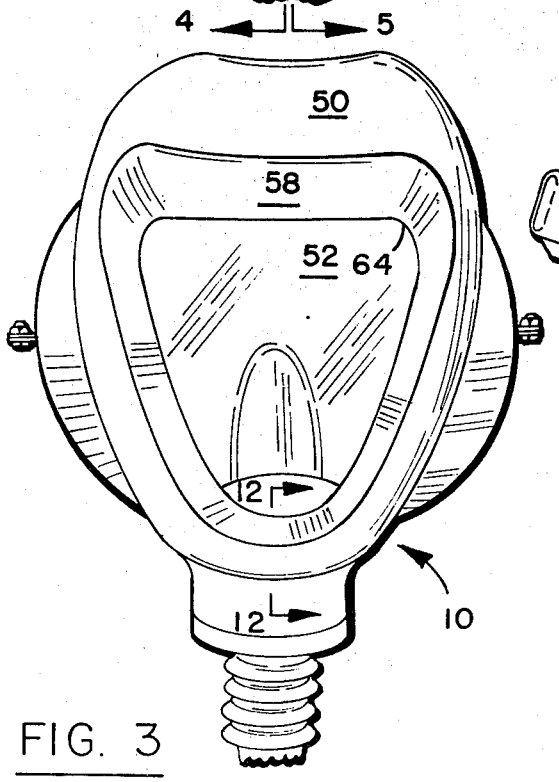
FIG. 3 shows a rear view looking inwardly into the facial seating and seal area of the gas mask as seen in the direction of lines 3—3 of FIG. 1.

Looking particularly at FIGS. 1, 2 and 3, it can be seen that a major mask body portion 10 has been shown. The main portion 10 is formed from an elastomeric substance, such as silicone rubber. It can of course be formed from other types of rubber and elastomers as well as certain pliable plastics. However, it has been found that silicone rubber is particularly adaptable to the facial features of a user, to provide a good seal, as well as being chemically and mechanically resilient.

The major mask portion 10 is generally formed in a mold which is of the type usually used for rubber and plastic molding. During the molding process, enlarged and thickened wall protuberances 12 and 14 are molded into the mask. The protuberances permit the attachment of buckle members 16 and 18 by rivets. The buckle members are riveted by means of rivets, respectively 20 and 22 that are connected to the large protuberance portions 12 and 14 that are molded into the rubber of the mask.

The buckle sections 16 and 18 have a midportion or cross member between the openings through which the strap member 24 is looped. This serves to secure the straps securely to the upper portion of a head band 26.

The lower buckle section 18 has been shown with a clasping engagement buckle 30 and a toothed retention member 32 which engages a strap portion 34 attached to the lower portion of the head band 26.

The toothed retention member 32 is rolled over in order to secure the strap 34 in a manner which is well known in the prior art. This, of course, can be accommodated by pulling the end of the strap 34 toward the head band 26 which engages the teeth tightly.

The straps on either side are bilaterally symmetrical and have been labeled accordingly in the drawings to indicate the symmetry between the two. Thus, the engagement previously described of the head band 26 is symmetrical on either side and one is merely an opposite version of the other.

Looking more particularly at the head band 26, it can be seen that it is formed in somewhat of a skull cap configuration having an upper portion 40 with openings 42, 44 and 46 therein. This allows for the head band to rest on one's head in a comfortable and even manner. The skull cap configuration terminates in the lower strap portion 34*a* which is such that it terminates into the strap 34 and an upper appendage 34*a* which terminates in a strap 24.

The head band in effect is such that it is secured to the back of one's head like a bonnet in order to accommodate and cover the head in a tight secure manner. This provides for a seating of the mask on the face while at the same time allowing the straps 24 and 34 to be moved. This movement for orientation allows for the mask 10 as described hereinafter, to be seated effectively on the face of the user as it is pulled backwardly into a user's face by the head band 26.

The buckle members or securing means 16 and 18 can be in any suitable form, so long as they engage and hold the straps 24 and 34 in a secure position. Furthermore, the head band 26 can be of any other configuration such as in the form of a spider, rather than the skull cap, or just a mere series of bands that extend from the pivot points 20 and 22. However, it is felt that the particular embodiment herein is a preferred embodiment in order to allow for the movement of the mask and the adjustability on one's facial features.

Looking more particularly at the mask 10 without the supports, it can be seen that a rubber molded main mask portion 50 has been molded to provide an enlarged interior opening 52 or cavity through the rear of the mask. The interior opening 52 provides an enlarged cavity 54 into which a user's face can extend. The enlarged cavity 54 is surrounded by a skirt 56 that circumscribes the major mask portion and has an interiorly directed seal 58 as a portion thereof. The seal 58 is formed from the skirt 56 turning inwardly from an apex 60 at an angular edge. The apex 60 is such that it allows for a resilient implacement of the skirt 56 against the face of a user. At the same time, the apex allows a spring movement or action of the seal 58 in its suspended position from the apex to engage a user's face around the periphery thereof. The seal 58 is generally at least an inch and a half from the exterior of the apex to the interior edge 64 of the seal.

The seal can be seen in the various cross sectional configurations of FIGS. 13, 14, and 15. In these configurations, it can be seen that a compound curve of varying arcuate configuration has been shown. This variable compound curve as it extends around the facial features, is such that it improves the seal. The midregions of the facial features generally require the seal cross section of FIG. 15. In the less cushioned portions of the face, such as the forehead, the leading edge 64 of the seal is of a flatter nature, in effect making the compound curve of the seal 58 more readily sealed against the forehead. This can be exemplified in the showing of FIG. 9 as it is impressed against the forehead in its flattened condition.

In other words, the greater arcuate seal 58 as shown in the other figures is not required at the forehead.

Figure 4:
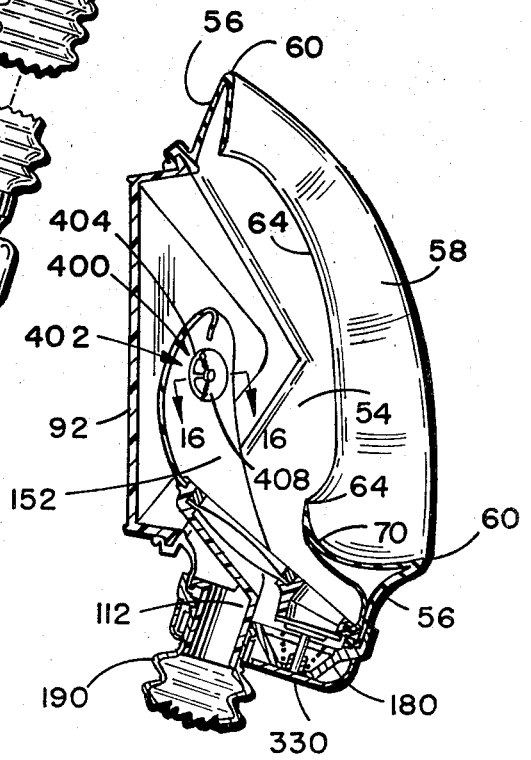
FIG. 4 is a midline sectional view through the mask without the head band.

Looking more particularly at FIG. 4 and the respective portions thereof, it can be seen in the chin section around the chin, as in FIG. 15, that a greater arcuate surface is required toward the bottom of the mask or chin cup 70 as shown. The leading edge 64 of the chin cup 70 is dramatically turned up against the end of a user's chin. The apex 60 thereof is particularly flexible and allows the upturned portion 64 to be sealed against a user's chin by the chin cup 70 seating thereagainst.

As can also be seen in FIG. 15, the portion of the seal 58 as it is directed toward the area of the chin, begins to turn up as a major arcuate curve 80 from the apex 60 thereof. Thus, the seal increases in depth, as well as the arcuate nature thereof as it proceeds from the forehead to the chin.

In effect, the foregoing seal 58 and skirt 56 with the variable cross sectioned configuration of the skirt and seal, provide for a variable compound curve throughout the seal at the periphery thereof. This accommodates a face in a superior manner to that of the prior art. Generally, the prior art merely had a seal which was substantially less than the one and one half inch seal at the distance from the apex 60 to the leading or interior edge 64. It furthermore did not provide a variable compound curve, but merely a generally flattened configuration around the entire facial structure. Lastly, it generally did not increase in its arcuate curved cross section, as well as its depth from the top of the mask to the bottom.

A detailed showing of the collapsing of the seal can be seen in FIG. 9 wherein the seal 58 has been collapsed from the showing of FIG. 10. This seal as can be seen is relatively straight or merely has a mild arcuate form from the apex 60 to the interior portion 64 or interior edge. As stated, this was the more typical seal of the prior art, but it would not function sufficiently around a user's face to provide a deep and well established seal.

The showing of FIG. 12 in its detail, shows the major portion or skirt 56 surrounding the chin pocket 70 where it extends inwardly from the apex 60 to the interior edge surface 64 which seats against a user's face around the chin.

The foregoing facial configuration is such that is allows for a superior seal over that which existed in the prior art. It also functions to provide for a comfortable fit that enables it to fit a wide variety of facial features of various users.

Looking more particularly at the frontal portion of the mask, it can be seen that a lens 90 has been shown. The lens 90 has a major facial portion or port 92. The major facial portion 92 curves across the face of the mask and provides a large viewing area through the mask. The major viewing portion 92 of the lens in the past has been subject to substantial scratches and abuse, due to the fact that when the mask is laid on its face, dirt and other abrasive materials scratch the lens. This is due to the fact that most of the lenses are made of a plastic material which does not have the scratch resistance of glass.

Accordingly, the lens of this invention across its major surface is protected by a substantial feature of this invention in the form of a bead 94 which circumscribes the major facial lens portion 92. This bead 94 can be seen in greater detail in FIGS. 9, 10 and 11. The bead is such that it raises the cross sectional surface of the lens from the surface upon which it is rested by causing the mask to rest on the bead. This thereby prevents scratching and deleterious substances such as dirt, rubbing up against the major lens portion 92. The bead can be substituted by protuberances on the lens surface or by segments of the bead with spaces therebetween. The main feature is to keep the major lens surface supported by way of a projection or protuberance therefrom.

The lens is molded as one entire piece with a circumferential flange 98 around the edge thereof. The circumferential flange 98 around the edge of the lens seats within a groove 100 within the skirt of the main mask portion 50. This groove 100 is provided with a pair of channel walls 102 and 104 on either side for receiving the lens therein.

A second channel 106 is utilized for purposes of receiving a clamping band 108 around the lens flange 98. In this manner, it clamps the lens flange 98 within the groove 100 by means of the clamp seating thereagainst.

The clamp 108 can be drawn together by two screws 110 and 112 as seen in FIG. 2. These screws 110 and 112 effectively compress the elastomeric material or the walls 104 and 106 on either side, so as to clamp the lens flange 98 therein.

The foregoing effectively seals the lens within the skirt 56 of the mask so as to allow it to be sealed against positive pressure flowing inwardly or outwardly therefrom.

Looking more particularly at the interior of the mask, it can be seen that a nozzle assembly 112 has been shown.

The nozzle assembly 112 can be cast as one integral piece. The integral piece can incorporate a tubular portion 114, and an upper deflector 116 connected thereto. The deflector 116 allows gas travelling in the direction of arrow A to be deflected in that direction and conveyed into the interior of the mask. The deflector 116 has an upper area incorporating an outlying portion 120 which has a diaphragm 122 seated therein. The diaphragm is seated by means of threading a ring 124 by means of threads 126 against a seat or ledge 128 having an O ring 130 therearound. In this manner, the diaphragm 122 is held in place and sealed by the O ring 130 and the clamping or tightening action of the ring 124.

The diaphragm is for speaking purposes and allows for transmission of sound by means of its oscillatory movement. The diaphragm surfaces 134 and 136 can be made of metal in the form of dish-shaped perforated menbers holding a plastic or elastomeric diaphragm 138 therebetween. Also, the diaphragm itself can be used without the concave members 134 and 136 or formed as a vibratory plastic sheet.

The nozzle portion 112 with its surrounding flange 120 has a groove 150 therein. The groove 150 receives an oral nasal mask 152 therein. In this manner, a user's nose and mouth, as can be seen, is implaced within the oral nasal mask 152 for coverage thereby.

The nozzle assembly 112 incorporates an opening 160 in the form of a round circular passage. The opening is provided with a poppet valve 162 that is held by a spring 164 against a seat 166. A spring 164 drives the poppet 162 upwardly and is guided by means of a stem 170 connected thereto which is received within a channel 172 within a lower base plate 180. The lower base plate 180 allows for the nozzle passage 114 to pass therethrough and receive a hose 190 therethrough for connecting to the walls of the tubular portion of the nozzle 112. The tubular portion of the nozzle 114 has a clamp 194 therearound that secures the elastomeric portion of the hose against the nozzle conduit 114.

The lower cover 180 is formed in a manner whereby the edge or lip 200 therearound is turned up in order to receive the base of the mask. In particular, a base or terminal portion 202 of the mask having an enlarged portion 204 therearound is received within the area provided by the edge 200 engaging the portion with the downturned edges of the nozzle assembly thereagainst. Thus, a tightened seal is provided by the edges 200 of the lower cover 180 pressing upwardly and holding the enlarged portion 204 against the base of the nozzle assembly edge region 120. Thus, engagement and sealing of the lower portion of the mask is accomplished by the lower cap 180 being held in place against the nozzle assembly 112.

Looking more particularly at FIGS. 6, 7 and 8 as derived from FIG. 5, it can be seen that the cover plate 180 comprises a webbed outlet 300 having three webs 302, 304 and 306 against which the poppet is mounted. In addition thereto, there are a plurality of sets of openings 308 and 310 which allow for the exit of air, as well as the emanation of sounds from a user's mouth.

A pair of screw holes 312 and 314 receive screws 316 and 318 that are within the outer shroud or cover 330. The outer shroud or cover is screwed in place by means of the screws 316 and 318 that are then screwed into the base of the nozzle assembly 120 as can be seen in FIG. 6 wherein screw hole 332 receives a screw therethrough.

The cover or shroud 330 is provided with a number of substantially annular openings 350 which allow for the exhaust of gas from the poppet 162 when it is opened, as well as providing for the transmission of sound, when one speaks against the diaphragm. Also, an opening 352 is provided through which the hose can pass with the clamp 194 therein.

In order to prevent the gas through the hose 190 from being reentrained into the mask after it has been breathed, the oral nasal mask 152 is utilized for purposes of covering the oral nasal area. As can be seen in FIGS. 4 and 5, as well as the interior showing of FIG. 3, the oral nasal mask in its attached seated configuration in groove 150, covers the mouth area, as well as the nose area.

Thus, upon exhalation, the air passes out through opening 160 when the poppet 162 receives positive pressure. However, in order to obtain breathing gas from the hose from the direction of arrow A, an inhalation valve 400 is utilized on either side of the oral nasal mask. This valve member 400 has a plurality of quadrants 402 that span a ringlike member 404 that is seated within the elastomeric material of the oral nasal mask 152.

The oral nasal mask inlet valve has an elastomeric flapper 408 that has been shown partially fragmented on a post 409. Flapper 408 in effect displaces inwardly upon inhalation and is sealed against the ring 404 during exhalation or positive pressure. In this manner, inhalation gas in the direction of arrow A can be delivered to the user upon demand through a demand regulator and exhaled through the opening 160 without being reentrained with the air of the hose 190 connected to the demand regulator or free flow source of breathing gas through the hose.

The improved seal with its arcuate section increasing in its curved manner from the chin cup to the forehead, as well as the protuberances or protective bead on the lens can be used in other configurations. In particular, the mask can be used without a pressurized supply of air from hose 190. Instead, it can incorporate a respirator cannister for filtering air. The oral nasal mask can be removed, and inhalation valve 400 substituted by a valve similar thereto across the nozzle inlet 114. Also, the exhalation valve poppet can be substituted by a flapper valve similar to the one in the oral nasal mask section. The mask has broad usage, including that of a full face mask respirator mask with breathing or filtering cannisters.

From the foregoing, it can be sen that this invention with its various features is a substantial step over the prior art of breathing gas masks. Thus, it should be read broadly in light of the following claims.

I claim:

1.

A breathing gas mask having a major plastic lens surface therein for viewing formed as a separate lens portion and connected to the remainder of the mask as an initially separable item wherein the improvement comprises:

said lens surface having a raised bead portion projecting outwardly therefrom in at least a portion of the peripheral region thereof for causing said lens to rest thereagainst instead of on the major lens surface to remove the major lens surface of the lens from a surface upon which it is placed so that it lies is speced relationship therefrom as supported by the raised bead portion.

2. The breathing gas mask as claimed in claim 1 wherein:

said mask has a seal around the interior thereof formed with a variable compound convexedly shaped curve through its cross section from the forehead portion of the mask to the chin portion of the mask.

3. The breathing gas mask as claimed in claim 2 wherein:

said seal in the chin region comprises an upturned cupshaped member for sealing against one's chin.

4. The breathing gas mask as claimed in claim 3 further comprising:

a diaphragm connected to said breathing gas mask through which one can speak.

5. The breathing gas mask as claimed in claim 4 further comprising:

an oral nasal mask interiorly of said mask allowing for inhalation from the mask cavity through a passage therein and exhalation from a conduit having an exhalation valve to which it is connected so that fresh breathing gas supplied within the mask cavity can be breathed from the passage into the oral nasal mask and exhaled therefrom through said valve in the exhalation conduit.

6. The breathing gas mask as claimed in claim 5 wherein:

said interior convexedly shaped seal is at least one and one half inches wide from its interior portion to its exterior portion.

7. An improved breathing gas mask having a lens therein, a skirt attached to said lens in the form of an elastomeric major body portion and a seal extending from said skirt into the mask wherein the improvement comprises:

a seal having a variable cross section compound concave curved surface increasing in its degree of curved conformation and distance measured between the outer portion and inner portion of the seal from the upper or forehead portion of said seal to the lower chin portion; and, a plastic lens therein formed separately from the other portion of the mask said lens surface having a bead projecting outwardly therefrom in at least a portion of the peripheral region thereof, so that when said major surface is rested on another surface it is in spaced relationship therefrom as supported by said bead.

8. The improved breathing gas mask as claimed in claim 7 further comprising:

a diaphragm mounted in said mask having an upper and lower metal cover portion with a vibratory member therebetween for transmitting vibratory sounds.

9. The improved breathing gas mask as claimed in claim 8 further comprising:

an oral nasal mask; and, an inlet nozzle having a deflector surface for deflecting incoming gas to the surface of the lens of said mask.

10. The breathing gas mask as claimed in claim 9 further comprising:

an inlet exhaust valve within said oral nasal mask for allowing breathing gas to flow thereinto while blocking said breathing gas from flowing exteriorly therefrom into the interior of the major cavity of said mask; and, a poppet valve connected to said oral nasal mask for receiving positive pressure for allowing exhalation therethrough.

11. A new and improved breathing gas mask having a mask body with a skirt around the area wherein a face is implaced and a major cavity therein with a seal extending from the edge of the skirt, wherein the improvement comprises:

a seal extending from the edge of the skirt and forming an apex therewith curving inwardly into the mask in a greater curved manner in the chin portion and progressing to a lesser curved portion at the forehead; and, wherein a plastic lens is provided over said cavity separably from the remainder of said mask for viewing purposes, said lens surface having a bead projecting outwardly therefrom in at least a portion of the peripheral region thereof for supporting the major surface of said lens from the surface on which it is rested.

12. The breathing gas mask as claimed in claim 11 wherein:

said seal is at least one and one half inches from the apex of where it joins the skirt to its interior edge throughout a substantial portion thereof.

13. The breathing gas mask as claimed in claim 11 further comprising:

a nozzle assembly seated within said mask adapted for connection to a source of breathing gas; and, a deflection plate in connected relationship to said nozzle for deflecting the flow of breathing gas thereto against the interior portion of the lens of said breathing gas mask to aid in the prevention of fog buildup thereon.

14. The breathing gas mask as claimed in claim 13 further comprising:

an oral nasal mask connected to a poppet outlet and having an inlet valve therein for receiving a breathing gas from the interior cavity of said gas mask.

15. The breathing gas mask as claimed in claim 14 further comprising:

a diaphragm seated in connected relationship to said oral nasal mask for imparting sounds from a user through said diaphragm; and, a cover for covering said poppet in part and said diaphragm having openings therethrough through which the gas from said poppet and sounds from said diaphragm can emanate.

* * * * *